US012751535B2

(12) United States Patent
Day et al.

(10) Patent No.: US 12,751,535 B2
(45) Date of Patent: Oct. 6, 2026

(54) HAIR CARE APPLIANCE WITH COOLED CIRCUITRY

(71) Applicant: SharkNinja Operating LLC, Needham, MA (US)

(72) Inventors: Michael Day, London (GB); Nicholas James Sardar, London (GB); Stephen Murphy, Watertown, MA (US); Erbo Song, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 817 days.

(21) Appl. No.: 18/169,645

(22) Filed: Feb. 15, 2023

(65) Prior Publication Data

US 2024/0225233 A1 Jul. 11, 2024

Related U.S. Application Data

(63) Continuation of application No. PCT/CN2023/071212, filed on Jan. 9, 2023.

(51) Int. Cl.
*A45D 20/12* (2006.01)

(52) U.S. Cl.
CPC ..... *A45D 20/12* (2013.01)

(58) Field of Classification Search
None
See application file for complete search history.

(56) References Cited

U.S. PATENT DOCUMENTS

| | | | |
|---|---|---|---|
| 6,895,975 | B2 | 5/2005 | Hafemann |
| 6,996,916 | B2 | 2/2006 | Cafaro |
| 7,040,037 | B2 | 5/2006 | Keong |
| 7,661,174 | B2 | 2/2010 | Park |
| 8,066,017 | B1 | 11/2011 | Born et al. |
| 8,209,877 | B2 | 7/2012 | Smal |
| 8,407,913 | B2 | 4/2013 | Langley et al. |
| 8,602,038 | B2 | 12/2013 | Choi |
| D715,995 | S | 10/2014 | Dyson et al. |
| D715,996 | S | 10/2014 | Dyson et al. |
| D716,492 | S | 10/2014 | Dyson et al. |

(Continued)

FOREIGN PATENT DOCUMENTS

| | | | |
|---|---|---|---|
| AU | 2011342980 | B2 | 7/2014 |
| AU | 2011298168 | B2 | 2/2015 |

(Continued)

OTHER PUBLICATIONS

English translation of CN 215837542 U.*

*Primary Examiner* — Jason Lau

(74) *Attorney, Agent, or Firm* — Mintz, Levin, Cohn, Ferris, Glovsky and Popeo, P.C.

(57) ABSTRACT

A hair care appliance is provided and includes a diverter configured to divert a portion of airflow from an airflow path through the body into the handle to cool electrical components disposed within the handle. In an exemplary embodiment, a hair care appliance is provided having a handle and a body coupled to the handle. A fan assembly is disposed within the body and is configured to generate an airflow. A first portion of the airflow can flow from an inlet of the body to an outlet of the body. A second portion of the airflow can flow into the handle to cool at least one electrical component provided in the handle.

20 Claims, 9 Drawing Sheets

(56) References Cited

U.S. PATENT DOCUMENTS

| | | | |
|---|---|---|---|
| 8,869,808 | B2 | 10/2014 | De Benedictis |
| D729,447 | S | 5/2015 | Gammack |
| D729,448 | S | 5/2015 | Gammack |
| D729,978 | S | 5/2015 | Bates et al. |
| D729,979 | S | 5/2015 | Gammack |
| D730,575 | S | 5/2015 | Bates et al. |
| D730,576 | S | 5/2015 | Gammack |
| 9,027,570 | B2 | 5/2015 | De Benedictis et al. |
| D731,117 | S | 6/2015 | Bates et al. |
| 9,144,286 | B2 | 9/2015 | Courtney et al. |
| D741,544 | S | 10/2015 | Gammack |
| 9,173,468 | B2 | 11/2015 | Moloney et al. |
| 9,237,789 | B2 | 1/2016 | Prehodka |
| 9,282,799 | B2 | 3/2016 | Courtney et al. |
| 9,282,800 | B2 | 3/2016 | Courtney et al. |
| D757,361 | S | 5/2016 | Gammack |
| D757,362 | S | 5/2016 | Dyson et al. |
| D758,010 | S | 5/2016 | Bates et al. |
| D758,011 | S | 5/2016 | Gammack |
| D758,012 | S | 5/2016 | Bates et al. |
| 9,414,662 | B2 | 8/2016 | Moloney et al. |
| 9,420,864 | B2 | 8/2016 | Gammack et al. |
| 9,510,395 | B2 | 11/2016 | Coulton et al. |
| D775,419 | S | 12/2016 | Stephens et al. |
| 9,516,938 | B2 | 12/2016 | Richmond et al. |
| 9,526,310 | B2 | 12/2016 | Courtney et al. |
| 9,578,943 | B2 | 2/2017 | Guy-rabi et al. |
| 9,578,945 | B2 | 2/2017 | Han |
| D782,731 | S | 3/2017 | Smith et al. |
| D782,732 | S | 3/2017 | Smith et al. |
| D782,733 | S | 3/2017 | Smith et al. |
| D782,735 | S | 3/2017 | Stephens et al. |
| D782,736 | S | 3/2017 | Stephens et al. |
| 9,591,906 | B2 | 3/2017 | Guy-rabi et al. |
| 9,596,916 | B2 | 3/2017 | Moloney et al. |
| D784,614 | S | 4/2017 | Stephens et al. |
| D785,240 | S | 4/2017 | Smith et al. |
| D785,241 | S | 4/2017 | Stephens et al. |
| 9,629,434 | B2 | 4/2017 | Debenedictis et al. |
| 9,675,157 | B2 | 6/2017 | Courtney et al. |
| 9,687,058 | B2 | 6/2017 | Atkinson |
| D791,407 | S | 7/2017 | Smith et al. |
| D798,502 | S | 9/2017 | Smith et al. |
| 9,788,625 | B2 | 10/2017 | De Benedictis et al. |
| 9,808,061 | B2 | 11/2017 | Ford et al. |
| 9,808,065 | B2 | 11/2017 | Moloney et al. |
| 9,808,067 | B2 | 11/2017 | Sutter et al. |
| 9,854,891 | B2 | 1/2018 | De Benedictis |
| 9,877,562 | B2 | 1/2018 | Guy-rabi et al. |
| D811,009 | S | 2/2018 | Smith et al. |
| 9,936,788 | B2 | 4/2018 | Stephens et al. |
| 9,936,789 | B2 | 4/2018 | Stephens et al. |
| D817,007 | S | 5/2018 | Guy-rabi et al. |
| 10,010,150 | B2 | 7/2018 | Courtney et al. |
| 10,016,040 | B2 | 7/2018 | Courtney et al. |
| 10,021,951 | B2 | 7/2018 | Bobillier et al. |
| 10,064,470 | B2 | 9/2018 | Warne |
| D830,630 | S | 10/2018 | Chia et al. |
| 10,085,537 | B2 | 10/2018 | Maclaine |
| 10,085,538 | B2 | 10/2018 | Saunders et al. |
| 10,117,491 | B2 | 11/2018 | Moloney et al. |
| 10,143,285 | B2 | 12/2018 | Stephens et al. |
| 10,165,843 | B2 | 1/2019 | Hedges |
| 10,165,844 | B2 | 1/2019 | Stephens et al. |
| 10,186,822 | B2 | 1/2019 | Hogan |
| 10,194,728 | B2 | 2/2019 | Stephens et al. |
| 10,213,001 | B2 | 2/2019 | Stephens et al. |
| D843,652 | S | 3/2019 | Mcluckie et al. |
| D843,653 | S | 3/2019 | Teyu et al. |
| D843,654 | S | 3/2019 | Teyu et al. |
| 10,226,112 | B2 | 3/2019 | Kerr et al. |
| 10,238,199 | B2 | 3/2019 | Stephens et al. |
| D847,421 | S | 4/2019 | Tappenden et al. |
| D847,422 | S | 4/2019 | Tappenden et al. |
| D847,423 | S | 4/2019 | Tappenden et al. |
| D847,424 | S | 4/2019 | Tappenden et al. |
| D847,425 | S | 4/2019 | Tappenden et al. |
| D847,426 | S | 4/2019 | Tappenden et al. |
| D848,063 | S | 5/2019 | Tappenden et al. |
| D848,064 | S | 5/2019 | Tappenden et al. |
| D848,065 | S | 5/2019 | Heffer et al. |
| D848,066 | S | 5/2019 | Coulton et al. |
| D848,067 | S | 5/2019 | Heffer et al. |
| D848,068 | S | 5/2019 | Heffer et al. |
| D848,675 | S | 5/2019 | Chia et al. |
| D850,001 | S | 5/2019 | Coulton et al. |
| 10,278,471 | B2 | 5/2019 | Shelton et al. |
| D852,415 | S | 6/2019 | Coulton et al. |
| D852,416 | S | 6/2019 | Coulton et al. |
| 10,306,965 | B2 | 6/2019 | Wilkinson et al. |
| D853,637 | S | 7/2019 | Coulton et al. |
| D853,638 | S | 7/2019 | Tappenden et al. |
| D853,639 | S | 7/2019 | Tappenden et al. |
| D853,640 | S | 7/2019 | Tappenden et al. |
| D853,641 | S | 7/2019 | Tappenden et al. |
| D853,642 | S | 7/2019 | Coulton et al. |
| D854,745 | S | 7/2019 | Chia et al. |
| D855,252 | S | 7/2019 | Coulton et al. |
| D856,579 | S | 8/2019 | Chia et al. |
| D856,580 | S | 8/2019 | Chia et al. |
| 10,383,422 | B2 | 8/2019 | Law et al. |
| 10,390,599 | B1 | 8/2019 | James et al. |
| D860,528 | S | 9/2019 | Atkinson et al. |
| D860,529 | S | 9/2019 | Atkinson et al. |
| D860,530 | S | 9/2019 | Atkinson et al. |
| D860,531 | S | 9/2019 | Atkinson et al. |
| D860,532 | S | 9/2019 | Atkinson et al. |
| D865,286 | S | 10/2019 | Atkinson et al. |
| 10,441,049 | B2 | 10/2019 | Douglas et al. |
| 10,441,050 | B2 | 10/2019 | Blanc et al. |
| 10,448,722 | B2 | 10/2019 | Mcluckie |
| 10,470,545 | B2 | 11/2019 | Thiebaut et al. |
| D869,763 | S | 12/2019 | Atkinson et al. |
| D869,764 | S | 12/2019 | Atkinson et al. |
| 10,575,617 | B2 | 3/2020 | Courtney et al. |
| 10,582,751 | B2 | 3/2020 | Courtney |
| 10,602,826 | B2 | 3/2020 | Wilkinson et al. |
| 10,610,000 | B2 | 4/2020 | Courtney et al. |
| D884,966 | S | 5/2020 | Flynn et al. |
| D885,663 | S | 5/2020 | Flynn et al. |
| 10,660,417 | B2 | 5/2020 | Bennett |
| 10,660,418 | B2 | 5/2020 | Degrood et al. |
| 10,687,595 | B2 | 6/2020 | Courtney et al. |
| 10,729,218 | B2 | 8/2020 | Childe et al. |
| 10,765,191 | B2 | 9/2020 | Stephens et al. |
| 10,786,061 | B2 | 9/2020 | Thiebaut et al. |
| 10,849,400 | B2 | 12/2020 | Weatherly et al. |
| 10,869,529 | B2 | 12/2020 | Chia et al. |
| 10,874,186 | B2 | 12/2020 | Macpherson et al. |
| 10,973,298 | B2 | 4/2021 | Kennedy et al. |
| D923,874 | S | 6/2021 | Kirkbride et al. |
| 11,033,088 | B2 | 6/2021 | Atkinson et al. |
| 11,044,979 | B2 | 6/2021 | Maclaine |
| 11,071,365 | B2 | 7/2021 | Maclaine et al. |
| 11,168,924 | B2 | 11/2021 | Naicker et al. |
| 11,172,745 | B2 | 11/2021 | Tam et al. |
| 11,296,621 | B2 | 4/2022 | Zheng et al. |
| 11,330,884 | B2 | 5/2022 | Degrood et al. |
| 11,589,660 | B2 | 2/2023 | Thompson et al. |
| 11,589,661 | B2 | 2/2023 | Guerreiro et al. |
| 2016/0262518 | A1 | 9/2016 | Guy-Rabi et al. |
| 2017/0273428 | A1 | 9/2017 | Nicolson et al. |
| 2017/0273429 | A1 | 9/2017 | Nicolson et al. |
| 2017/0310249 | A1 | 10/2017 | Zheng et al. |
| 2018/0055182 | A1 | 3/2018 | Thompson et al. |
| 2019/0223572 | A1 | 7/2019 | Ahrens |
| 2019/0357653 | A1 | 11/2019 | Guerreiro et al. |
| 2019/0380463 | A1 | 12/2019 | Guerreiro et al. |
| 2020/0037725 | A1 | 2/2020 | Ahrens |
| 2020/0085163 | A1 | 3/2020 | James et al. |
| 2020/0221845 | A1* | 7/2020 | Goldman ..... F26B 21/001 |
| 2020/0237070 | A1 | 7/2020 | Degrood et al. |
| 2020/0397111 | A1 | 12/2020 | Bouchar |
| 2021/0000237 | A1 | 1/2021 | Kennedy et al. |

(56) References Cited

U.S. PATENT DOCUMENTS

| | | | |
|---|---|---|---|
| 2021/0285328 A1 | 9/2021 | Mahmoodilari et al. | |
| 2021/0381527 A1 | 12/2021 | Peet et al. | |
| 2022/0190751 A1 | 6/2022 | Zheng et al. | |
| 2022/0209307 A1* | 6/2022 | McBride | H01M 10/4207 |

FOREIGN PATENT DOCUMENTS

| | | | | |
|---|---|---|---|---|
| AU | 2013239504 | B2 | 4/2015 | |
| AU | 2013239510 | B2 | 10/2015 | |
| AU | 2013285200 | B2 | 11/2015 | |
| AU | 2013285201 | B2 | 1/2016 | |
| AU | 2014202857 | B2 | 8/2016 | |
| AU | 2014389903 | A1 | 9/2016 | |
| AU | 2013283014 | B2 | 2/2017 | |
| AU | 2014285903 | B2 | 2/2017 | |
| AU | 2013261059 | B2 | 5/2017 | |
| AU | 2014285903 | C1 | 5/2017 | |
| AU | 201714987 | S | 9/2017 | |
| AU | 201714988 | S | 9/2017 | |
| AU | 2015233175 | B2 | 9/2017 | |
| AU | 201715704 | S | 10/2017 | |
| AU | 201715709 | S | 10/2017 | |
| AU | 201715713 | S | 10/2017 | |
| AU | 201717218 | S | 12/2017 | |
| AU | 201717219 | S | 12/2017 | |
| AU | 201717220 | S | 12/2017 | |
| AU | 201717221 | S | 12/2017 | |
| AU | 201717222 | S | 12/2017 | |
| AU | 201717232 | S | 12/2017 | |
| AU | 201717235 | S | 12/2017 | |
| AU | 201717236 | S | 12/2017 | |
| AU | 201717237 | S | 12/2017 | |
| AU | 201717246 | S | 12/2017 | |
| AU | 2015233174 | B2 | 12/2017 | |
| AU | 201810343 | S | 2/2018 | |
| AU | 201810344 | S | 2/2018 | |
| AU | 201810345 | S | 2/2018 | |
| AU | 201810346 | S | 2/2018 | |
| AU | 201810348 | S | 2/2018 | |
| AU | 201810466 | S | 2/2018 | |
| AU | 201810467 | S | 2/2018 | |
| AU | 201810472 | S | 2/2018 | |
| AU | 2017101822 | A4 | 2/2018 | |
| AU | 201811153 | S | 3/2018 | |
| AU | 201811154 | S | 3/2018 | |
| AU | 201811828 | S | 4/2018 | |
| AU | 2016277577 | B2 | 8/2018 | |
| AU | 2018204763 | A1 | 1/2019 | |
| AU | 2018201042 | B2 | 8/2019 | |
| AU | 2017318546 | B2 | 7/2020 | |
| AU | 2017393026 | B2 | 12/2020 | |
| AU | 2018441457 | A1 | 4/2021 | |
| CA | 2873465 | A1 | 11/2013 | |
| CA | 2943399 | A1 | 9/2015 | |
| CA | 3011101 | A1 | 1/2019 | |
| CA | 3109771 | A1 | 3/2020 | |
| CN | 101662969 | B | 8/2011 | |
| CN | 203168302 | U | 9/2013 | |
| CN | 203168303 | U | 9/2013 | |
| CN | 203220053 | U | 10/2013 | |
| CN | 203328162 | U | 12/2013 | |
| CN | 203369521 | U | 1/2014 | |
| CN | 203369522 | U | 1/2014 | |
| CN | 203524054 | U | 4/2014 | |
| CN | 101896091 | B | 8/2014 | |
| CN | 104287408 | A | 1/2015 | |
| CN | 204292438 | U | 4/2015 | |
| CN | 204317818 | U | 5/2015 | |
| CN | 204483371 | U | 7/2015 | |
| CN | 204483372 | U | 7/2015 | |
| CN | 204483373 | U | 7/2015 | |
| CN | 204499778 | U | 7/2015 | |
| CN | 104921436 | A | 9/2015 | |
| CN | 104921437 | A | 9/2015 | |
| CN | 104968235 | A | 10/2015 | |
| CN | 204742992 | U | 11/2015 | |
| CN | 204796991 | U | 11/2015 | |
| CN | 204796992 | U | 11/2015 | |
| CN | 103565076 | B | 12/2015 | |
| CN | 105231630 | A | 1/2016 | |
| CN | 103355925 | B | 2/2016 | |
| CN | 103228170 | B | 3/2016 | |
| CN | 103549750 | B | 3/2016 | |
| CN | 105433576 | A | 3/2016 | |
| CN | 103237475 | B | 5/2016 | |
| CN | 102665479 | B | 7/2016 | |
| CN | 103355930 | B | 8/2016 | |
| CN | 103519541 | B | 8/2016 | |
| CN | 205456831 | U | 8/2016 | |
| CN | 106256283 | A | 12/2016 | |
| CN | 106256286 | A | 12/2016 | |
| CN | 205963257 | U | 2/2017 | |
| CN | 205963258 | U | 2/2017 | |
| CN | 103355927 | B | 3/2017 | |
| CN | 205993856 | U | 3/2017 | |
| CN | 206043777 | U | 3/2017 | |
| CN | 206043778 | U | 3/2017 | |
| CN | 206043779 | U | 3/2017 | |
| CN | 103355926 | B | 4/2017 | |
| CN | 103355928 | B | 4/2017 | |
| CN | 103355929 | B | 4/2017 | |
| CN | 103519540 | B | 4/2017 | |
| CN | 206150740 | U | 5/2017 | |
| CN | 206295038 | U | 7/2017 | |
| CN | 206338218 | U | 7/2017 | |
| CN | 206354632 | U | 7/2017 | |
| CN | 107006989 | A | 8/2017 | |
| CN | 206517192 | U | 9/2017 | |
| CN | 107224080 | A | 10/2017 | |
| CN | 107259762 | A * | 10/2017 | A45D 20/124 |
| CN | 206651501 | U | 11/2017 | |
| CN | 206699677 | U | 12/2017 | |
| CN | 206744836 | U | 12/2017 | |
| CN | 104026843 | B | 1/2018 | |
| CN | 104337192 | B | 1/2018 | |
| CN | 104042020 | B | 2/2018 | |
| CN | 207023591 | U | 2/2018 | |
| CN | 207023592 | U | 2/2018 | |
| CN | 104411205 | B | 3/2018 | |
| CN | 107788666 | A | 3/2018 | |
| CN | 104042022 | B | 4/2018 | |
| CN | 207168088 | U | 4/2018 | |
| CN | 207322932 | U | 5/2018 | |
| CN | 207322933 | U | 5/2018 | |
| CN | 207355685 | U | 5/2018 | |
| CN | 104273921 | B | 6/2018 | |
| CN | 108135342 | A | 6/2018 | |
| CN | 207544575 | U | 6/2018 | |
| CN | 207544576 | U | 6/2018 | |
| CN | 108402637 | A | 8/2018 | |
| CN | 108567216 | A | 9/2018 | |
| CN | 207803715 | U | 9/2018 | |
| CN | 104273917 | B | 10/2018 | |
| CN | 104273919 | B | 10/2018 | |
| CN | 104510138 | B | 10/2018 | |
| CN | 207927983 | U | 10/2018 | |
| CN | 207939324 | U | 10/2018 | |
| CN | 104273920 | B | 11/2018 | |
| CN | 104510137 | B | 11/2018 | |
| CN | 208144697 | U | 11/2018 | |
| CN | 105392386 | A | 12/2018 | |
| CN | 108991700 | A | 12/2018 | |
| CN | 109259408 | A | 1/2019 | |
| CN | 208339134 | U | 1/2019 | |
| CN | 104273918 | B | 2/2019 | |
| CN | 208463170 | U | 2/2019 | |
| CN | 208524016 | U | 2/2019 | |
| CN | 105559311 | B | 4/2019 | |
| CN | 106989039 | B | 5/2019 | |
| CN | 209073632 | U | 7/2019 | |
| CN | 104921435 | B | 8/2019 | |
| CN | 106256287 | B | 8/2019 | |
| CN | 110074535 | A | 8/2019 | |
| CN | 106165958 | B | 9/2019 | |

(56) References Cited

FOREIGN PATENT DOCUMENTS

| | | | | | |
|---|---|---|---|---|---|
| CN | 106333459 | B | | 9/2019 | |
| CN | 105639974 | B | | 10/2019 | |
| CN | 110325073 | A | | 10/2019 | |
| CN | 209573664 | U | | 11/2019 | |
| CN | 110582215 | A | | 12/2019 | |
| CN | 105473022 | B | | 2/2020 | |
| CN | 210055005 | U | | 2/2020 | |
| CN | 210055006 | U | | 2/2020 | |
| CN | 106256282 | B | | 3/2020 | |
| CN | 111202335 | A | | 5/2020 | |
| CN | 105686301 | B | | 6/2020 | |
| CN | 105795679 | B | | 6/2020 | |
| CN | 111248594 | A | | 6/2020 | |
| CN | 104042021 | B | | 7/2020 | |
| CN | 111432684 | A | | 7/2020 | |
| CN | 106820534 | B | | 8/2020 | |
| CN | 211154233 | U | | 8/2020 | |
| CN | 105407757 | B | | 10/2020 | |
| CN | 106880155 | B | | 10/2020 | |
| CN | 106974416 | B | | 10/2020 | |
| CN | 106974415 | B | | 11/2020 | |
| CN | 107847031 | B | | 11/2020 | |
| CN | 108206600 | B | | 11/2020 | |
| CN | 211984215 | U | | 11/2020 | |
| CN | 211984221 | U | | 11/2020 | |
| CN | 108272207 | B | | 12/2020 | |
| CN | 212185556 | U | | 12/2020 | |
| CN | 112336037 | A | | 2/2021 | |
| CN | 108618334 | B | | 4/2021 | |
| CN | 106963093 | B | | 5/2021 | |
| CN | 108618333 | B | | 5/2021 | |
| CN | 213096652 | U | | 5/2021 | |
| CN | 213215774 | U | | 5/2021 | |
| CN | 106165959 | B | | 6/2021 | |
| CN | 107224085 | B | | 6/2021 | |
| CN | 107317521 | B | | 6/2021 | |
| CN | 106256284 | B | | 7/2021 | |
| CN | 113080592 | A | | 7/2021 | |
| CN | 105407756 | B | | 8/2021 | |
| CN | 106901482 | B | | 8/2021 | |
| CN | 107224087 | B | | 8/2021 | |
| CN | 107224077 | B | | 9/2021 | |
| CN | 113437901 | A | | 9/2021 | |
| CN | 109247685 | B | | 10/2021 | |
| CN | 109788833 | B | | 11/2021 | |
| CN | 113786051 | A | | 12/2021 | |
| CN | 215837542 | U | | 2/2022 | |
| CN | 109674176 | B | | 3/2022 | |
| CN | 114401648 | A | * | 4/2022 | ..... A45D 20/10 |
| CN | 114468512 | A | | 5/2022 | |
| CN | 108851461 | B | | 6/2022 | |
| CN | 114587058 | A | | 6/2022 | |
| CN | 114680439 | A | | 7/2022 | |
| CO | 6721018 | A2 | | 7/2013 | |
| CR | 20130272 | A | | 1/2014 | |
| EP | 1779745 | B1 | | 5/2008 | |
| EP | 2242393 | B1 | | 4/2013 | |
| EP | 2611329 | B1 | | 8/2014 | |
| EP | 2736375 | B1 | | 9/2015 | |
| EP | 2651260 | B1 | | 10/2015 | |
| EP | 2745729 | B1 | | 11/2015 | |
| EP | 2656746 | B1 | | 12/2015 | |
| EP | 3119235 | A1 | | 1/2017 | |
| EP | 3119236 | A1 | | 1/2017 | |
| EP | 2975966 | B1 | | 4/2017 | |
| EP | 2736374 | B1 | | 6/2017 | |
| EP | 2863770 | B1 | | 6/2017 | |
| EP | 2862476 | B1 | | 1/2018 | |
| EP | 3324782 | A1 | | 5/2018 | |
| EP | 2830462 | B1 | | 6/2018 | |
| EP | 3016545 | B1 | | 6/2018 | |
| EP | 3158890 | B1 | | 8/2018 | |
| EP | 2849605 | B1 | | 10/2018 | |
| EP | 3024352 | B1 | | 10/2018 | |
| EP | 3335586 | B1 | | 11/2018 | |
| EP | 3206523 | B1 | | 12/2018 | |
| EP | 3016541 | B1 | | 1/2019 | |
| EP | 3235397 | B1 | | 2/2019 | |
| EP | 3310207 | B1 | | 2/2019 | |
| EP | 2611328 | B1 | | 3/2019 | |
| EP | 3079521 | B1 | | 4/2019 | |
| EP | 3172985 | B1 | | 4/2019 | |
| EP | 3232853 | B1 | | 4/2019 | |
| EP | 3016540 | B1 | | 5/2019 | |
| EP | 3048926 | B1 | | 6/2019 | |
| EP | 3048925 | B1 | | 7/2019 | |
| EP | 3506786 | A1 | | 7/2019 | |
| EP | 3512372 | A1 | | 7/2019 | |
| EP | 3516986 | A1 | | 7/2019 | |
| EP | 3364816 | B1 | | 10/2019 | |
| EP | 3568038 | A1 | | 11/2019 | |
| EP | 3568039 | A1 | | 11/2019 | |
| EP | 2830457 | B1 | | 12/2019 | |
| EP | 2830459 | B1 | | 12/2019 | |
| EP | 2620075 | B2 | | 2/2020 | |
| EP | 3622780 | A1 | | 3/2020 | |
| EP | 2869726 | B1 | | 4/2020 | |
| EP | 2869727 | B1 | | 4/2020 | |
| EP | 3432759 | B1 | | 6/2020 | |
| EP | 3016544 | B1 | | 7/2020 | |
| EP | 3310204 | B1 | | 7/2020 | |
| EP | 3687335 | A1 | | 8/2020 | |
| EP | 3328237 | B1 | | 11/2020 | |
| EP | 3319473 | B1 | | 2/2021 | |
| EP | 3432757 | B1 | | 2/2021 | |
| EP | 3119234 | B1 | | 11/2021 | |
| EP | 3009027 | B2 | | 6/2022 | |
| EP | 3849373 | A4 | | 6/2022 | |
| EP | 3028596 | B1 | | 7/2022 | |
| EP | 3427609 | B1 | | 9/2022 | |
| FR | 3039377 | B1 | | 9/2017 | |
| GB | 2477834 | B | | 2/2012 | |
| GB | 2455716 | C | | 2/2013 | |
| GB | 2501175 | B | | 4/2014 | |
| GB | 2500798 | B | | 5/2014 | |
| GB | 2500800 | B | | 5/2014 | |
| GB | 2501379 | B | | 5/2014 | |
| GB | 2500801 | B | | 7/2014 | |
| GB | 2511219 | B | | 5/2015 | |
| GB | 2515809 | B | | 8/2015 | |
| GB | 2515810 | B | | 11/2015 | |
| GB | 2515811 | B | | 11/2015 | |
| GB | 2515812 | B | | 2/2016 | |
| GB | 2516478 | B | | 3/2016 | |
| GB | 2518639 | B | | 3/2016 | |
| GB | 201605028 | | | 5/2016 | |
| GB | 2497057 | B | | 8/2016 | |
| GB | 201612054 | | | 8/2016 | |
| GB | 2531431 | B | | 11/2016 | |
| GB | 2521144 | B | | 12/2016 | |
| GB | 2526768 | B | | 2/2017 | |
| GB | 2516249 | B | | 3/2017 | |
| GB | 2503683 | B | | 4/2017 | |
| GB | 2524304 | B | | 4/2017 | |
| GB | 2526049 | B | | 4/2017 | |
| GB | 2515813 | B | | 7/2017 | |
| GB | 2543135 | B | | 11/2017 | |
| GB | 2533324 | B | | 12/2017 | |
| GB | 2503687 | B | | 2/2018 | |
| GB | 2547138 | B | | 3/2018 | |
| GB | 2534379 | B | | 5/2018 | |
| GB | 2545412 | B | | 6/2018 | |
| GB | 2539437 | B | | 7/2018 | |
| GB | 2540203 | B | | 7/2018 | |
| GB | 2551852 | B | | 9/2018 | |
| GB | 201818400 | | | 12/2018 | |
| GB | 2539432 | B | | 1/2019 | |
| GB | 2539441 | B | | 1/2019 | |
| GB | 2543536 | B | | 1/2019 | |
| GB | 2558415 | B | | 2/2019 | |
| GB | 2543751 | B | | 4/2019 | |
| GB | 2549740 | B | | 4/2019 | |
| GB | 2561093 | B | | 4/2019 | |
| GB | 2538560 | B | | 5/2019 | |

(56) References Cited

FOREIGN PATENT DOCUMENTS

| | | | |
|---|---|---|---|
| GB | 2561094 | B | 5/2019 |
| GB | 2548822 | B | 8/2019 |
| GB | 2548816 | B | 9/2019 |
| GB | 2548812 | B | 10/2019 |
| GB | 2553516 | B | 1/2020 |
| GB | 2565698 | B | 1/2020 |
| GB | 2548616 | B | 2/2020 |
| GB | 2548813 | B | 2/2020 |
| GB | 2560888 | B | 4/2020 |
| GB | 2548819 | B | 5/2020 |
| GB | 2557958 | B | 5/2020 |
| GB | 2560889 | B | 9/2020 |
| GB | 2567661 | B | 9/2020 |
| GB | 202015444 | | 11/2020 |
| GB | 202015445 | | 11/2020 |
| GB | 202101269 | | 3/2021 |
| GB | 2562276 | B | 4/2021 |
| GB | 2576017 | B | 4/2021 |
| GB | 202102691 | | 4/2021 |
| GB | 2560356 | B | 5/2021 |
| GB | 2575297 | B | 5/2021 |
| GB | 2581371 | B | 9/2021 |
| GB | 2581372 | B | 12/2021 |
| GB | 2603174 | A | 8/2022 |
| GB | 2603175 | A | 8/2022 |
| GB | 2603176 | A | 8/2022 |
| GB | 2603177 | A | 8/2022 |
| GB | 2580416 | B | 9/2022 |
| JP | 2001527427 | A | 12/2001 |
| JP | 5361906 | B2 | 9/2013 |
| JP | 2013212383 | A | 10/2013 |
| JP | 2013212385 | A | 10/2013 |
| JP | 2013212387 | A | 10/2013 |
| JP | 2013212388 | A | 10/2013 |
| JP | 2014012142 | A | 1/2014 |
| JP | 2014012143 | A | 1/2014 |
| JP | 2014521444 | A | 8/2014 |
| JP | 5636441 | B2 | 10/2014 |
| JP | 2014217770 | A | 11/2014 |
| JP | 5674852 | B2 | 1/2015 |
| JP | 2015013124 | A | 1/2015 |
| JP | 2015013125 | A | 1/2015 |
| JP | 2015013127 | A | 1/2015 |
| JP | 2015023798 | A | 2/2015 |
| JP | 2015024137 | A | 2/2015 |
| JP | 5709926 | B2 | 3/2015 |
| JP | 5722403 | B2 | 4/2015 |
| JP | 2015066446 | A | 4/2015 |
| JP | 2015066447 | A | 4/2015 |
| JP | 2015097941 | A | 5/2015 |
| JP | 5758944 | B2 | 6/2015 |
| JP | 6760030 | B2 | 6/2015 |
| JP | 2015181946 | A | 10/2015 |
| JP | 2015181947 | A | 10/2015 |
| JP | 2016040008 | A | 3/2016 |
| JP | 2016083586 | A | 5/2016 |
| JP | 2016112423 | A | 6/2016 |
| JP | 2016112424 | A | 6/2016 |
| JP | 2016129688 | A | 7/2016 |
| JP | 2016129780 | A | 7/2016 |
| JP | 2016131890 | A | 7/2016 |
| JP | 2016523648 | A | 8/2016 |
| JP | 2016526429 | A | 9/2016 |
| JP | 2017006664 | A | 1/2017 |
| JP | 2017006665 | A | 1/2017 |
| JP | 2017006666 | A | 1/2017 |
| JP | 2017006668 | A | 1/2017 |
| JP | 2017012789 | A | 1/2017 |
| JP | 2017018593 | A | 1/2017 |
| JP | 2017502735 | A | 1/2017 |
| JP | 2017077470 | A | 4/2017 |
| JP | 2017077471 | A | 4/2017 |
| JP | 2017077472 | A | 4/2017 |
| JP | 2017079592 | A | 4/2017 |
| JP | 2017512589 | A | 5/2017 |
| JP | 2017140364 | A | 8/2017 |
| JP | 2017148598 | A | 8/2017 |
| JP | 2017170147 | A | 9/2017 |
| JP | 2017170149 | A | 9/2017 |
| JP | 2017170150 | A | 9/2017 |
| JP | 2017185217 | A | 10/2017 |
| JP | 2017200432 | A | 11/2017 |
| JP | 2017209536 | A | 11/2017 |
| JP | 2018033968 | A | 3/2018 |
| JP | 2018043010 | A | 3/2018 |
| JP | 2018086277 | A | 6/2018 |
| JP | 2018110514 | A | 7/2018 |
| JP | 2018134441 | A | 8/2018 |
| JP | 2018158110 | A | 10/2018 |
| JP | 2018158111 | A | 10/2018 |
| JP | 2018190728 | A | 11/2018 |
| JP | 2019076720 | A | 5/2019 |
| JP | 2019141560 | A | 8/2019 |
| JP | 2019193568 | A | 10/2019 |
| JP | 2020505721 | A | 2/2020 |
| JP | 3225772 | U | 3/2020 |
| JP | 2020047605 | A | 3/2020 |
| JP | 3226032 | U | 4/2020 |
| JP | 2020099758 | A | 7/2020 |
| JP | 2020535860 | A | 12/2020 |
| JP | 6838006 | B2 | 2/2021 |
| JP | 6854109 | B2 | 3/2021 |
| JP | 6861790 | B2 | 4/2021 |
| JP | 6890571 | B2 | 5/2021 |
| JP | 2021087838 | A | 6/2021 |
| JP | 6924442 | B2 | 8/2021 |
| JP | 2021166822 | A | 10/2021 |
| JP | 2022509442 | A | 1/2022 |
| KR | 101196487 | B1 | 11/2012 |
| KR | 101229109 | B1 | 2/2013 |
| KR | 20130025752 | A | 3/2013 |
| KR | 20140129309 | A | 11/2014 |
| KR | 20140129310 | A | 11/2014 |
| KR | 20140129322 | A | 11/2014 |
| KR | 20140129323 | A | 11/2014 |
| KR | 20140129324 | A | 11/2014 |
| KR | 101468416 | B1 | 12/2014 |
| KR | 20140138797 | A | 12/2014 |
| KR | 200475794 | Y1 | 1/2015 |
| KR | 20150023773 | A | 3/2015 |
| KR | 20150023774 | A | 3/2015 |
| KR | 20160020555 | A | 2/2016 |
| KR | 20160020556 | A | 2/2016 |
| KR | 20160020557 | A | 2/2016 |
| KR | 20160020558 | A | 2/2016 |
| KR | 20160021265 | A | 2/2016 |
| KR | 20160021294 | A | 2/2016 |
| KR | 20160021862 | A | 2/2016 |
| KR | 20160052719 | A | 5/2016 |
| KR | 20160052720 | A | 5/2016 |
| KR | 20160052721 | A | 5/2016 |
| KR | 20160075829 | A | 6/2016 |
| KR | 20160075831 | A | 6/2016 |
| KR | 20160079142 | A | 7/2016 |
| KR | 20160079144 | A | 7/2016 |
| KR | 20160079146 | A | 7/2016 |
| KR | 101660347 | B1 | 9/2016 |
| KR | 20160126073 | A | 11/2016 |
| KR | 20160126074 | A | 11/2016 |
| KR | 20160004256 | U | 12/2016 |
| KR | 101693281 | B1 | 1/2017 |
| KR | 20170001743 | A | 1/2017 |
| KR | 101713997 | B1 | 3/2017 |
| KR | 101726280 | B1 | 4/2017 |
| KR | 20170001222 | U | 4/2017 |
| KR | 101761297 | B1 | 7/2017 |
| KR | 20170084313 | A | 7/2017 |
| KR | 101768582 | B1 | 8/2017 |
| KR | 101771206 | B1 | 8/2017 |
| KR | 20170095961 | A | 8/2017 |
| KR | 20170105099 | A | 9/2017 |
| KR | 20170105100 | A | 9/2017 |
| KR | 20170139700 | A | 12/2017 |
| KR | 101814567 | B1 | 1/2018 |

(56) References Cited

FOREIGN PATENT DOCUMENTS

| | | | |
|---|---|---|---|
| KR | 101817701 | B1 | 1/2018 |
| KR | 20180010248 | A | 1/2018 |
| KR | 20180017193 | A | 2/2018 |
| KR | 20180017194 | A | 2/2018 |
| KR | 20180017196 | A | 2/2018 |
| KR | 20180017197 | A | 2/2018 |
| KR | 20180030620 | A | 3/2018 |
| KR | 101844912 | B1 | 4/2018 |
| KR | 20180033312 | A | 4/2018 |
| KR | 101855222 | B1 | 5/2018 |
| KR | 101855223 | B1 | 5/2018 |
| KR | 101861140 | B1 | 5/2018 |
| KR | 20180069051 | A | 6/2018 |
| KR | 20180069894 | A | 6/2018 |
| KR | 20180071986 | A | 6/2018 |
| KR | 20180072754 | A | 6/2018 |
| KR | 20180086444 | A | 7/2018 |
| KR | 101900840 | B1 | 9/2018 |
| KR | 20180105275 | A | 9/2018 |
| KR | 101906844 | B1 | 10/2018 |
| KR | 101909949 | B1 | 10/2018 |
| KR | 20180110243 | A | 10/2018 |
| KR | 101921159 | B1 | 11/2018 |
| KR | 20180003187 | U | 11/2018 |
| KR | 20180003188 | U | 11/2018 |
| KR | 20180003197 | U | 11/2018 |
| KR | 20180120253 | A | 11/2018 |
| KR | 20180120254 | A | 11/2018 |
| KR | 20180120815 | A | 11/2018 |
| KR | 20180121607 | A | 11/2018 |
| KR | 20180121984 | A | 11/2018 |
| KR | 20180124165 | A | 11/2018 |
| KR | 20180128480 | A | 12/2018 |
| KR | 101946431 | B1 | 2/2019 |
| KR | 101949900 | B1 | 2/2019 |
| KR | 20190017075 | A | 2/2019 |
| KR | 101953713 | B1 | 3/2019 |
| KR | 101953714 | B1 | 3/2019 |
| KR | 101963674 | B1 | 3/2019 |
| KR | 101964103 | B1 | 4/2019 |
| KR | 101965272 | B1 | 4/2019 |
| KR | 20190037328 | A | 4/2019 |
| KR | 20190038930 | A | 4/2019 |
| KR | 20190040108 | A | 4/2019 |
| KR | 101953711 | B1 | 5/2019 |
| KR | 101978707 | B1 | 5/2019 |
| KR | 101983111 | B1 | 5/2019 |
| KR | 20190001036 | U | 5/2019 |
| KR | 101990944 | B1 | 6/2019 |
| KR | 101992734 | B1 | 6/2019 |
| KR | 102007214 | B1 | 8/2019 |
| KR | 102007215 | B1 | 8/2019 |
| KR | 102007355 | B1 | 8/2019 |
| KR | 200489784 | Y1 | 8/2019 |
| KR | 20190090682 | A | 8/2019 |
| KR | 102018622 | B1 | 9/2019 |
| KR | 102018623 | B1 | 9/2019 |
| KR | 102010940 | B1 | 10/2019 |
| KR | 102030102 | B1 | 10/2019 |
| KR | 102030103 | B1 | 10/2019 |
| KR | 102031600 | B1 | 10/2019 |
| KR | 20190122864 | A | 10/2019 |
| KR | 102041173 | B1 | 11/2019 |
| KR | 20190126159 | A | 11/2019 |
| KR | 20190141227 | A | 12/2019 |
| KR | 200490784 | Y1 | 1/2020 |
| KR | 102074285 | B1 | 2/2020 |
| KR | 200491247 | Y1 | 3/2020 |
| KR | 102101642 | B1 | 4/2020 |
| KR | 102101643 | B1 | 4/2020 |
| KR | 102102243 | B1 | 4/2020 |
| KR | 102121904 | B1 | 6/2020 |
| KR | 20200068710 | A | 6/2020 |
| KR | 102143436 | B1 | 8/2020 |
| KR | 102158115 | B1 | 9/2020 |
| KR | 102175883 | B1 | 11/2020 |
| KR | 102179911 | B1 | 11/2020 |
| KR | 102210212 | B1 | 1/2021 |
| KR | 20210012063 | A | 2/2021 |
| KR | 102270980 | B1 | 6/2021 |
| KR | 102270981 | B1 | 6/2021 |
| KR | 20210080545 | A | 6/2021 |
| KR | 102319738 | B1 | 11/2021 |
| KR | 102319796 | B1 | 11/2021 |
| KR | 102328006 | B1 | 11/2021 |
| KR | 102336278 | B1 | 12/2021 |
| KR | 20210156324 | A | 12/2021 |
| KR | 102349191 | B1 | 1/2022 |
| KR | 102383039 | B1 | 4/2022 |
| WO | 2009077747 | A3 | 10/2009 |
| WO | 2011078593 | A3 | 11/2011 |
| WO | 2012028862 | A1 | 3/2012 |
| WO | 2012080751 | A3 | 9/2012 |
| WO | 2013016583 | A1 | 1/2013 |
| WO | 2013144569 | A1 | 10/2013 |
| WO | 2013144570 | A1 | 10/2013 |
| WO | 2013144571 | A1 | 10/2013 |
| WO | 2013144572 | A1 | 10/2013 |
| WO | 2013144574 | A1 | 10/2013 |
| WO | 2013144575 | A1 | 10/2013 |
| WO | 2013144576 | A1 | 10/2013 |
| WO | 2013171732 | A1 | 11/2013 |
| WO | 2013171750 | A1 | 11/2013 |
| WO | 2014006365 | A1 | 1/2014 |
| WO | 2014006366 | A1 | 1/2014 |
| WO | 2014001770 | A3 | 3/2014 |
| WO | 2014147460 | A8 | 11/2014 |
| WO | 2014201424 | A1 | 12/2014 |
| WO | 2015001303 | A1 | 1/2015 |
| WO | 2015001304 | A1 | 1/2015 |
| WO | 2015001305 | A1 | 1/2015 |
| WO | 2015001306 | A1 | 1/2015 |
| WO | 2015001307 | A1 | 1/2015 |
| WO | 2015001308 | A1 | 1/2015 |
| WO | 2015001310 | A1 | 1/2015 |
| WO | 2015008024 | A1 | 1/2015 |
| WO | 2015011442 | A1 | 1/2015 |
| WO | 2015044644 | A1 | 4/2015 |
| WO | 2015044645 | A1 | 4/2015 |
| WO | 2015087040 | A1 | 6/2015 |
| WO | 2015087043 | A1 | 6/2015 |
| WO | 2015008025 | A3 | 7/2015 |
| WO | 2015140506 | A1 | 9/2015 |
| WO | 2015140507 | A1 | 9/2015 |
| WO | 2015140508 | A1 | 9/2015 |
| WO | 2016072657 | A1 | 5/2016 |
| WO | 2016097682 | A1 | 6/2016 |
| WO | 2016097683 | A1 | 6/2016 |
| WO | 2016113523 | A1 | 7/2016 |
| WO | 2016116728 | A1 | 7/2016 |
| WO | 2016116729 | A1 | 7/2016 |
| WO | 2016189270 | A1 | 12/2016 |
| WO | 2016196916 | A1 | 12/2016 |
| WO | 2016203195 | A1 | 12/2016 |
| WO | 2016203196 | A1 | 12/2016 |
| WO | 2016203197 | A1 | 12/2016 |
| WO | 2016203198 | A1 | 12/2016 |
| WO | 2017009595 | A1 | 1/2017 |
| WO | 2017016865 | A1 | 2/2017 |
| WO | 2017068320 | A1 | 4/2017 |
| WO | 2017068321 | A1 | 4/2017 |
| WO | 2017068322 | A1 | 4/2017 |
| WO | 2017098200 | A1 | 6/2017 |
| WO | 2017098204 | A1 | 6/2017 |
| WO | 2017163003 | A1 | 9/2017 |
| WO | 2017163005 | A1 | 9/2017 |
| WO | 2017163007 | A1 | 9/2017 |
| WO | 2017163066 | A1 | 9/2017 |
| WO | 2017163068 | A1 | 9/2017 |
| WO | 2017187128 | A3 | 12/2017 |
| WO | 2018042154 | A1 | 3/2018 |
| WO | 2018051059 | A1 | 3/2018 |
| WO | 2018051113 | A1 | 3/2018 |
| WO | 2018130798 | A1 | 7/2018 |

(56) References Cited

FOREIGN PATENT DOCUMENTS

| | | | |
|---|---|---|---|
| WO | 2018130832 | A1 | 7/2018 |
| WO | 2018162878 | A1 | 9/2018 |
| WO | 2018172734 | A1 | 9/2018 |
| WO | 2018172735 | A1 | 9/2018 |
| WO | 2018206911 | A1 | 11/2018 |
| WO | 2019077301 | A1 | 4/2019 |
| WO | 2020008163 | A1 | 1/2020 |
| WO | 2020055436 | A1 | 3/2020 |
| WO | 2020055519 | A1 | 3/2020 |
| WO | 2020089579 | A1 | 5/2020 |
| WO | 2020257765 | A1 | 12/2020 |
| WO | 2019067716 | A9 | 12/2021 |
| WO | 2022069857 | A1 | 4/2022 |
| WO | 2022069858 | A1 | 4/2022 |
| WO | 2022069859 | A1 | 4/2022 |
| WO | 2022069860 | A1 | 4/2022 |
| WO | 2022069864 | A1 | 4/2022 |
| WO | 2022069865 | A1 | 4/2022 |
| WO | 2022069881 | A1 | 4/2022 |
| WO | 2022162336 | A1 | 8/2022 |
| WO | 2022162337 | A1 | 8/2022 |
| WO | 2022162338 | A1 | 8/2022 |
| WO | 2022162339 | A1 | 8/2022 |
| WO | 2022162340 | A1 | 8/2022 |

* cited by examiner

HAIR CARE APPLIANCE WITH COOLED CIRCUITRY

CROSS REFERENCE TO RELATED APPLICATIONS

This application is a continuation of and claims priority to WO Application No. PCT/CN2023/071212 filed on Jan. 9, 2023. The entire contents of which is incorporated herein by reference in its entirety.

FIELD OF THE INVENTION

Hair care appliances and methods for using the same are provided.

BACKGROUND

Hair care appliances are devices used for drying and styling of hair. Hair care appliances can include a variety of components operable to provide an airflow extending through the device. The airflow can include ambient air directed through the hair care appliance via a motor and fan assembly. The airflow can be further directed across a heating assembly to generate heated air at an outlet of the hair care appliance. Airflow can be expelled from the hair care appliance to enable a user to dry or style hair. One or more heat generating electrical components can be included in a handle of the hair care appliance.

To avoid overheating and to adequately cool heat generating electrical components, prior hair care appliances place the heat generating electrical components directly within the airflow generated by the fan assembly (e.g., within a body of the hair care appliance). As a result, airflow through the hair care appliance can be reduced. To compensate for the reduced airflow, prior hair care appliances can require heavier, more powerful motors and fan assemblies, which can increase the weight and costs of such devices.

Accordingly, there remains a need for improved hair care appliances.

SUMMARY

In general, hair care devices and accessories are provided for use in drying and/or styling hair. In one aspect, a hair care appliance is provided and includes a handle and a body coupled to the handle. The body can include a fan assembly configured to generate an airflow, wherein a first portion of the airflow flows from an inlet of the body to an outlet of the body and a second portion of the airflow flows into the handle to cool at least one electrical component provided in the handle.

In one embodiment, the body can include a diverter configured to direct the second portion of the airflow into the handle. In certain aspects, the diverter can be positioned to generate the second portion of the airflow from the first portion of the airflow exiting the fan assembly. In another embodiment, the handle can include a first portion having the electrical component(s) and a second portion that is fluidically sealed from the first portion of the handle. In certain aspects, the second portion of the airflow can be excluded from the second portion of the handle.

In another embodiment, the airflow can flow into the first portion of the handle and can circulate around the at least one electrical component prior to flowing into the body to join with the first portion of the airflow exiting the fan assembly. In some embodiment, the diverter can be configured at an angle relative to the first portion of the airflow, and/or the diverter can be configured parallel to the second portion of the airflow.

In another aspect, a hair care appliance is provided having a body with an inlet, an outlet, and a fan assembly positioned between the inlet and the outlet. The fan assembly can be configured to generate an airflow from the inlet to the outlet. The hair care appliance can also include a handle including a first section having a first end coupled to the body and a second end coupled to a second section of the handle fluidically sealed from the first section. The first section can include at least one electrical component therein. A portion of the airflow can flow into the first section of the handle to cool the at least one electrical component.

In one embodiment, the second section of the handle can include at least one electrical component therein. The electrical component(s) in the second section can have a maximum heat output that can be less than a maximum heat output of the electrical component(s) in the first section. In another embodiment, the handle can include a sealing element configured to fluidically seal the first section of the handle from the second section of the handle. In another embodiment, the first end of the handle can include an opening configured to receive the portion of the air flow. The opening can be configured to be in fluidic connection with the airflow exiting the fan assembly.

In another aspect, a hair care appliance is provided and includes a frame having a first portion extending along a first axis and a second portion extending along a second axis transverse to the first axis. The first portion of the frame can have a fan assembly and a heater assembly disposed therein, and the second portion of the frame can have at least one electrical component therein. The hair care appliance can also include a body positioned at least partially around the first portion of the frame and including an inlet and an outlet. The fan assembly can be configured to generate an airflow from the inlet, through the fan assembly, to the outlet. The hair care appliance can also include a handle positioned at least partially around the second portion of the frame.

In some embodiments, the frame can include a first inner frame structure coupled to a second inner frame structure, such that the first portion of the frame and a first portion of the airflow can be parallel to the first axis. In another embodiment, the first inner frame structure can include a first plurality of walls and the second inner frame structure can include a second plurality of walls. The first and second plurality of walls can extend into the handle and can form a compartment in a first section of the handle. The compartment can contain the electrical component(s). In another embodiment, the first plurality of walls can be coupled to the second plurality of walls via a sealing element, such that the compartment in the first section of the handle is fluidically sealed from a second section of the handle.

In another embodiment, at least one wall of the first plurality of walls and at least one wall of the second plurality of walls can form a diverter to direct a second portion of the airflow into the compartment, the second portion of the airflow can be transverse to the first portion of the airflow. In another embodiment, the first section of the handle can include a first plurality of electrical components and the second section of the handle can include a second plurality of electrical components. The first plurality of electrical components can have a maximum heat output that can be higher than a maximum heat output of the second plurality of electrical components. In another embodiment, the at least one electrical component can include a metal-oxide-semiconductor field-effect transistor configured on a printed circuit board positioned within the handle.

DESCRIPTION OF DRAWINGS

These and other features will be more readily understood from the following detailed description taken in conjunction with the accompanying drawings, in which.

Figure 1:
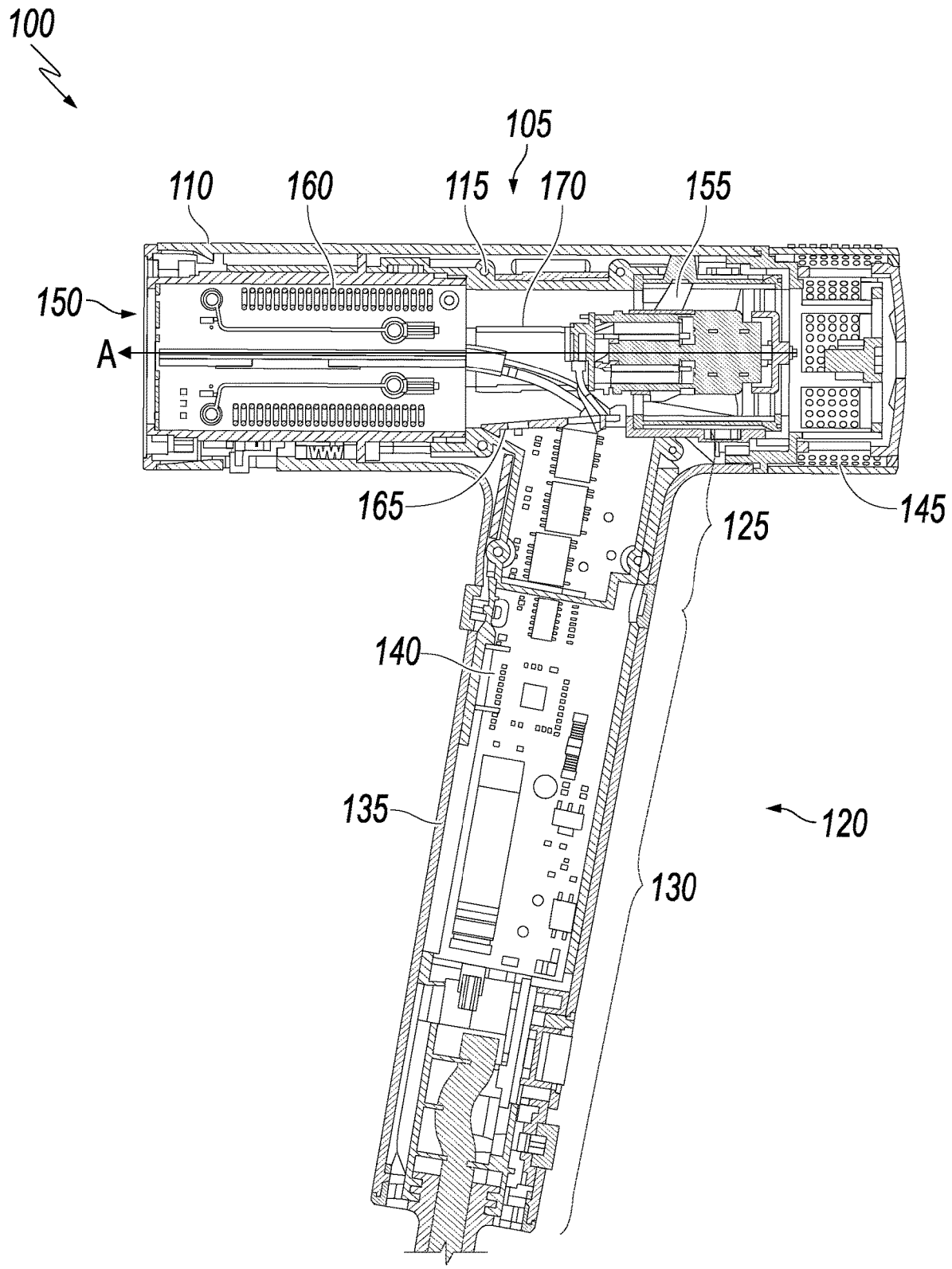
FIG. 1 is a side cross-sectional view of one embodiment of a hair care appliance configured to cool electrical components therein.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Embodiments herein provide a hair care appliance configured to provide cooling to electrical components arranged within the hair care appliance. In general, the hair care appliance is in the form of a hair dryer that has a handle and a body that are coupled to one another. The handle can include one or more electrical components that can be provided in various locations throughout the handle. The body can include an inlet, an outlet, and a fan assembly configured to generate an airflow from the inlet to the outlet. A portion of the airflow exiting the fan assembly can be diverted into the handle to provide cooling for electrical components located therein. The airflow diversion can be achieved to advantageously provide sufficient cooling for the electrical components without reducing or altering the airflow provided through the outlet of the hair care appliance.

FIGS. 1-3C illustrate an exemplary embodiment of a hair care appliance 100 configured to provide cooling to electrical components located in a handle thereof. As shown, the hair care appliance 100 generally includes a body 105 coupled to a handle 120. In the illustrated embodiment, the body 105 and the handle 120 each include a cover 110, 135 with an internal frame 115 disposed within a portion thereof. In some embodiments, the internal frame 115 can include two inner frame structures configured to mate to one another in a clam-shell manner along an axis of the body. As further shown, the handle 120 includes a first section 125 and a second section 130. Each section 125, 130 can include one or more various electrical components located therein. The handle 120 also includes a printed circuit board (PCB) 140. The electrical components located in the handle 120 can be arranged at various locations on the PCB 140.

An airflow A can be generated through the body 105. Air can enter the body 105 at an inlet 145, flow through the body 105 and portions of the handle 120, before exiting at an outlet 150. The body 105 can include a fan assembly 155, including a motor and a fan, which can generate the airflow A through the body 105 and portions of the handle 120. The body 105 can also include a heater assembly 160 configured to heat the airflow A. In an exemplary embodiment, at least a portion of the airflow A is configured to be diverted from the handle into a portion of the body to air in cooling the electrical components. In the illustrated embodiment, the body 105 includes a diverter 165 formed on the internal frame 115 and oriented to divert a portion of the airflow A into the first section 125 of the handle 120 to provide cooling to electrical components located therein. In order to allow the diverter 165 to divert air effective to cool the electrical components, the heater assembly 160 is preferably positioned downstream of the diverter 165, while the fan is positioned upstream of the diverter 165. In some embodiments, the heater assembly (and an inductor coil thereof) can have a maximal heat output of 75 C.

Figure 2:
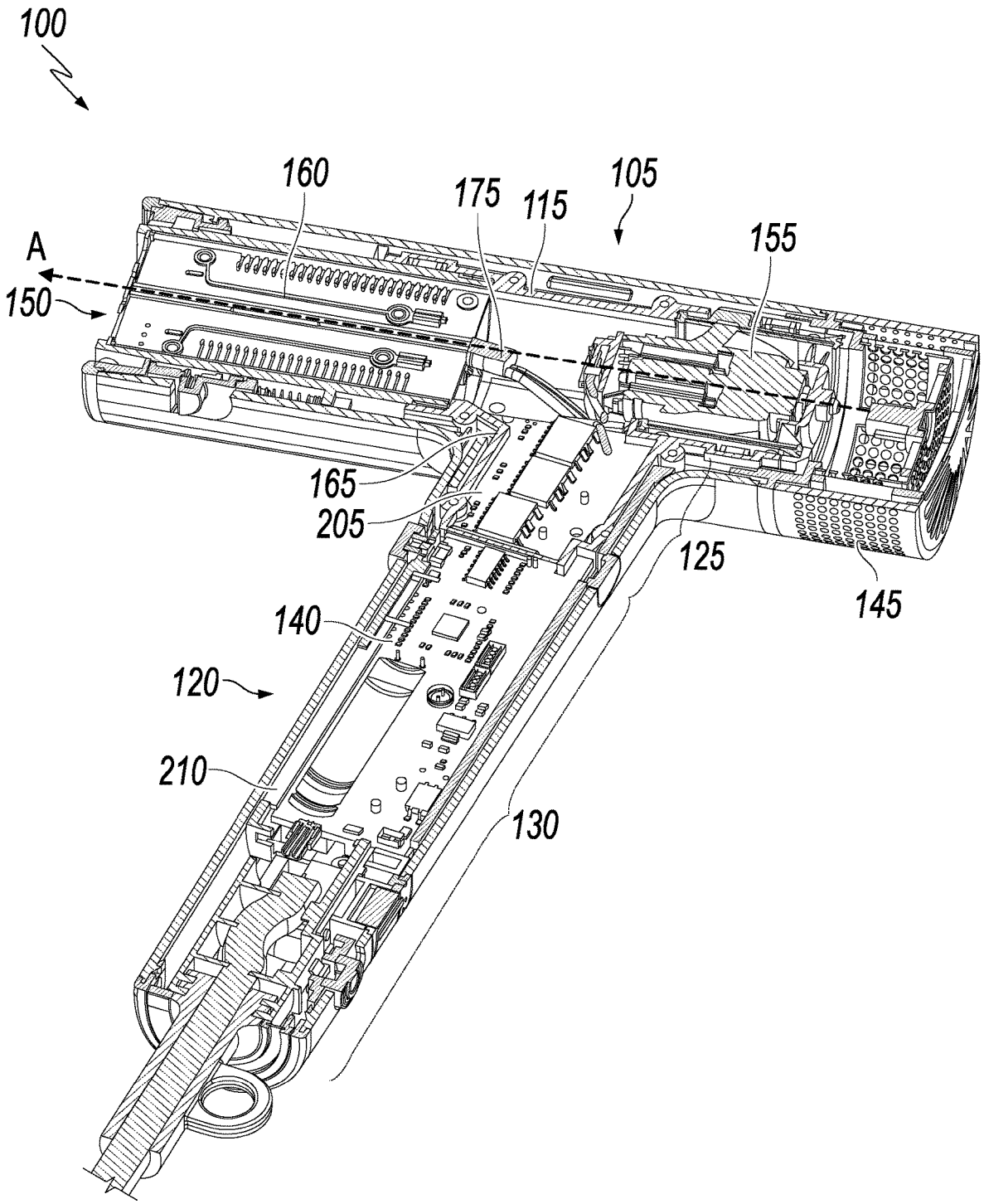
FIG. 2 is a side perspective view of the hair care appliance of FIG. 1.

As indicated above, electrical components can be located in the first section 125 of the handle 120 and/or the second section 130 of the handle 120, as shown in FIG. 2. For example, a first set of electrical components 205 (encircled with a dashed line in FIGS. 2 and 3A) can be arranged on the PCB 140 in the first section 125 of the handle 120, and a second set of electrical components 210 (encircled with a dashed line in FIGS. 2 and 3A) can be arranged on the PCB 140 in the second section 130 of the handle 120.

In some embodiments, the first set of electrical components 205 and/or the second set of electrical components 210 can include transistors, resistors, capacitors, microprocessors, microcontrollers, wires, circuits, ground fault circuit interrupters, sensors, thermostats, or the like. Electrical components generally generate a maximum heat output corresponding to an maximal amount of thermal energy that the electrical component will generate during operation of the hair care appliance 100. In an exemplary embodiment, the first set of electrical components 205 located in the first section 125 of the handle 120 have a higher maximum heat output than the second plurality of electrical components 210 located in the second section 130 of the handle 120. In this way, the first set of electrical components 205 having higher maximal heat outputs can advantageously be cooled via a portion of the airflow A diverted by the diverter 165. The first set of electrical components 205 can include, for example, the microcontroller which controls the heater and motor. In some embodiments, the microcontroller can have a maximal heat output of 125 C. By way of non-limiting example, the first set of electrical components 205 can be metal-oxide-semiconductor field-effect transistors. The placement of individual electrical components of the first set of electrical components 205 can be arranged such that the electrical components with the greatest maximal heat output are placed closest to the body 105 and the diverter 165, and the electrical component with lower maximal heat output are placed farther away from the body 105 and the diverter 165. In this way, the diverted portion A2 of the airflow A contacts the electrical component with the greatest need for heat mitigation first.

Figure 3A:
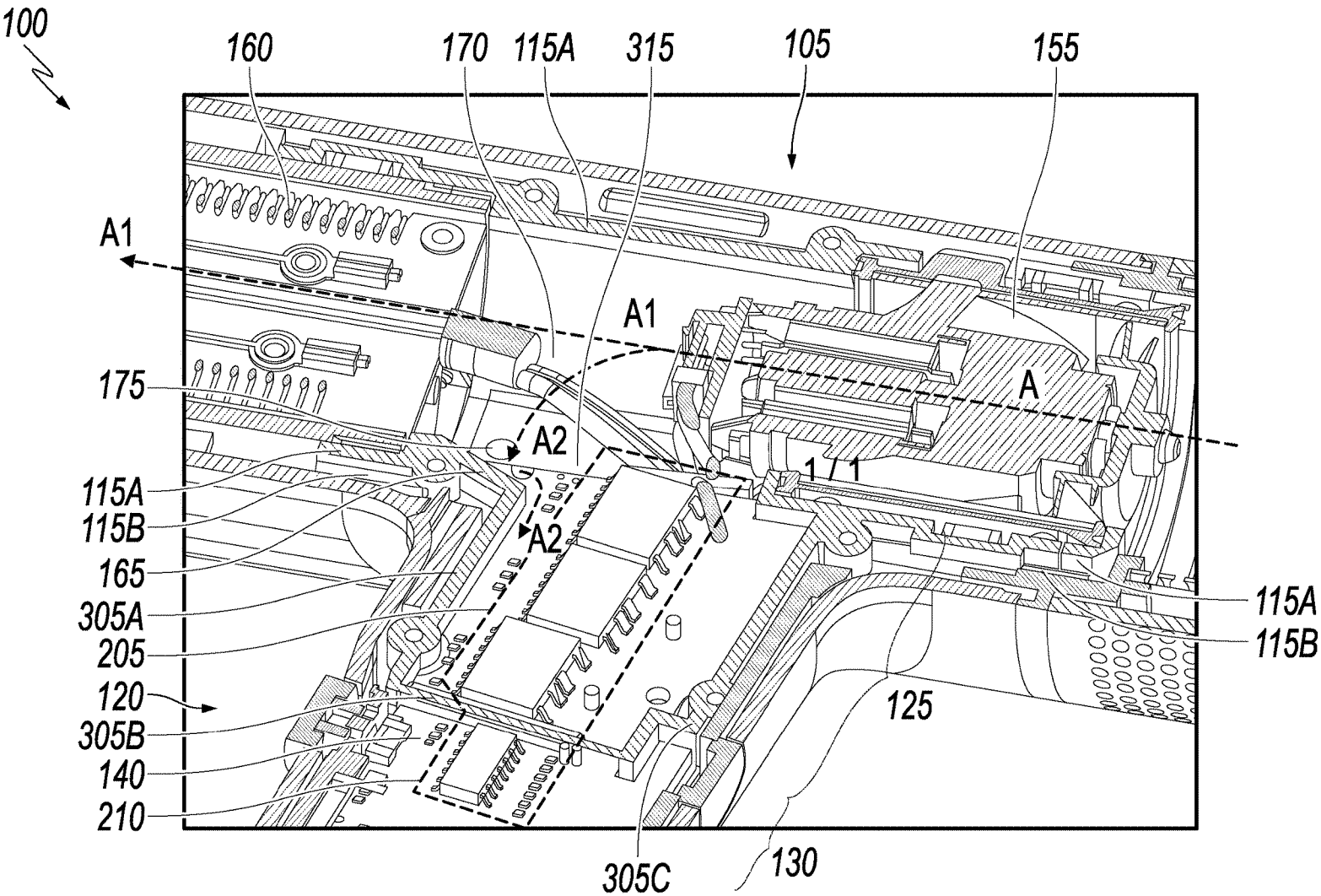
FIG. 3A is a close-up side perspective view of the hair care appliance of FIG. 1.

The hair care appliance 100 can also include one or more heat sinks, which can further aid in cooling the electrical components. In some embodiments, a heat sink 170 can be positioned adjacent to one or more alternating current triodes, or TRIACs 175, as shown in FIG. 3A. The heat sink 170 can include one or more planar elements adjacent to the TRIAC 175. As shown in FIG. 3A, one planar element of the heat sink 170 is shown adjacent to the TRIAC 175. The TRIAC 175 can have a maximal heat output of 110 C. The TRIAC 175 can be configured to control power supplied to the heater assembly 160 and can generate heat within the body 105.

Figure 3B:
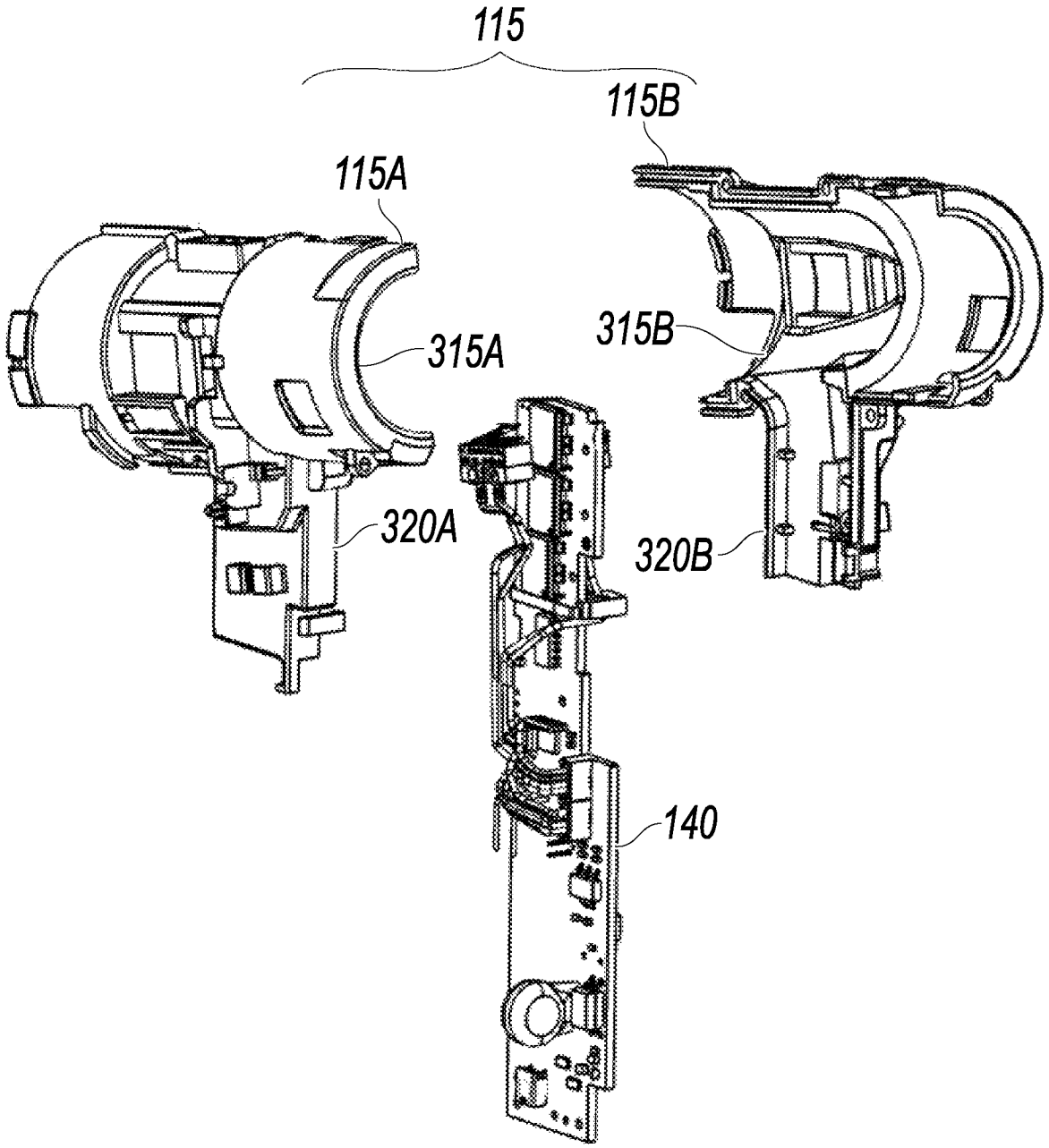
FIG. 3B is a perspective, exploded view of an inner frame structure and printed circuit board of the hair care appliance of FIG. 1.

As indicated above, the appliance 100 can include an internal frame 115, which can be formed from a pair of matching internal frame structures 115A, 115B, as shown in FIGS. 3A and 3B. The internal frame 115 can include an upper portion 315 (shown as 315A and 315B in FIG. 3B) in the form of a hollow cylinder defining a lumen extending therethrough, and a lower portion 320 (shown as 320A and 320B in FIG. 3B) extending downward from the upper portion. The upper portion 315 can be disposed within the body 105 and aligned with the airflow path such that air from the inlet flows through the cylindrical portion to the outlet. The lower portion 320 can extend at least partially into the handle 120 and can receive a portion of the PCB 140 therein. The two halves of the internal frame 115 (e.g., internal frame structures 115A, 115B) that mate to one another can be configured to mate around a portion of the PCB to seal a portion of the PCB therein separate from the remainder of the PCB 140. As a result, the lower portion 320 of the frame 115 can define the first section 125 of the handle, and the remainder of the PCB 140 be positioned within the second section 130 of the handle.

Figure 3C:
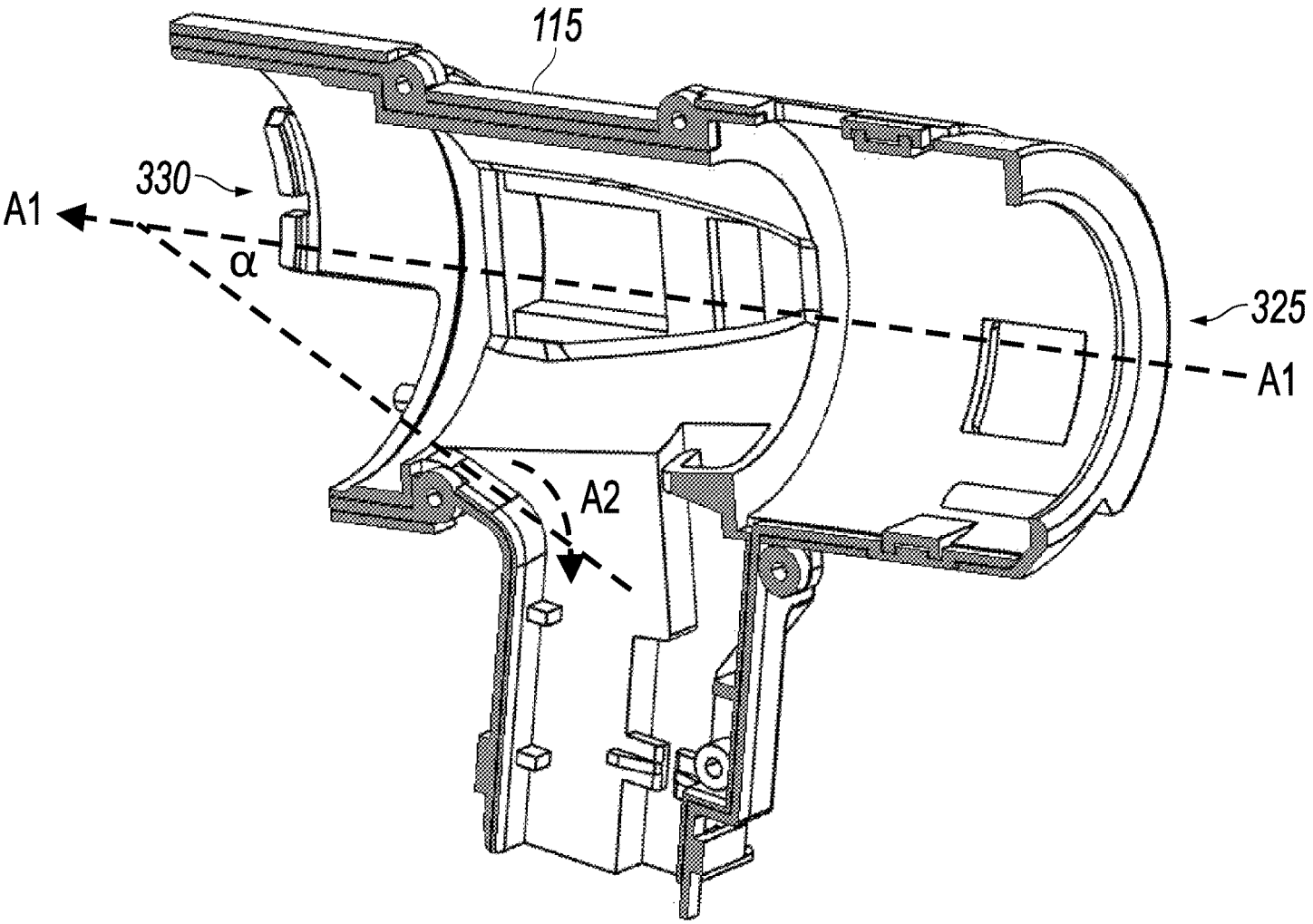
FIG. 3C is a cross-sectional view of one half of the inner frame structure of FIG. 3B.

As previously explained, the appliance 110 can include a diverter for redirecting a portion of the airflow into the handle 120. In one embodiment, as shown in more detail in FIG. 3C, the diverter 165 can be formed on or integrally with the internal frame 115. In the illustrated embodiment, the diverter 165 is positioned at an intersection between the body 105 and the handle 120 along a portion of the opening 315 that is closer to an outlet 330 of the internal frame 115A than to the inlet 325 of the internal frame 325, as shown in FIG. 3C with respect to internal frame structure 115A. The diverter 165 can be in the form of an angled wall that is oriented at an angle $\alpha$ relative to a longitudinal axis A1 of the airflow A. In this way, the diverter 165 can divert a portion A2 of the airflow A into the sealed lower portion 320 of the internal frame 115 located within the first section 125 of the handle 120. The airflow A2 can be diverted to circulate over and around the PCB 140 to provide cooling to the first set of electrical components 205. In certain exemplary embodiments, the diverter 165 can be configured at an angle and a position relative to the fan assembly 155 to provide the portion A1 of the airflow A via the outlet 150 with minimal reduction in velocity compared to the velocity immediately exiting the fan assembly 155 (e.g., prior to portion A2 being diverted into the first section 125 of the handle 120).

Figure 4:
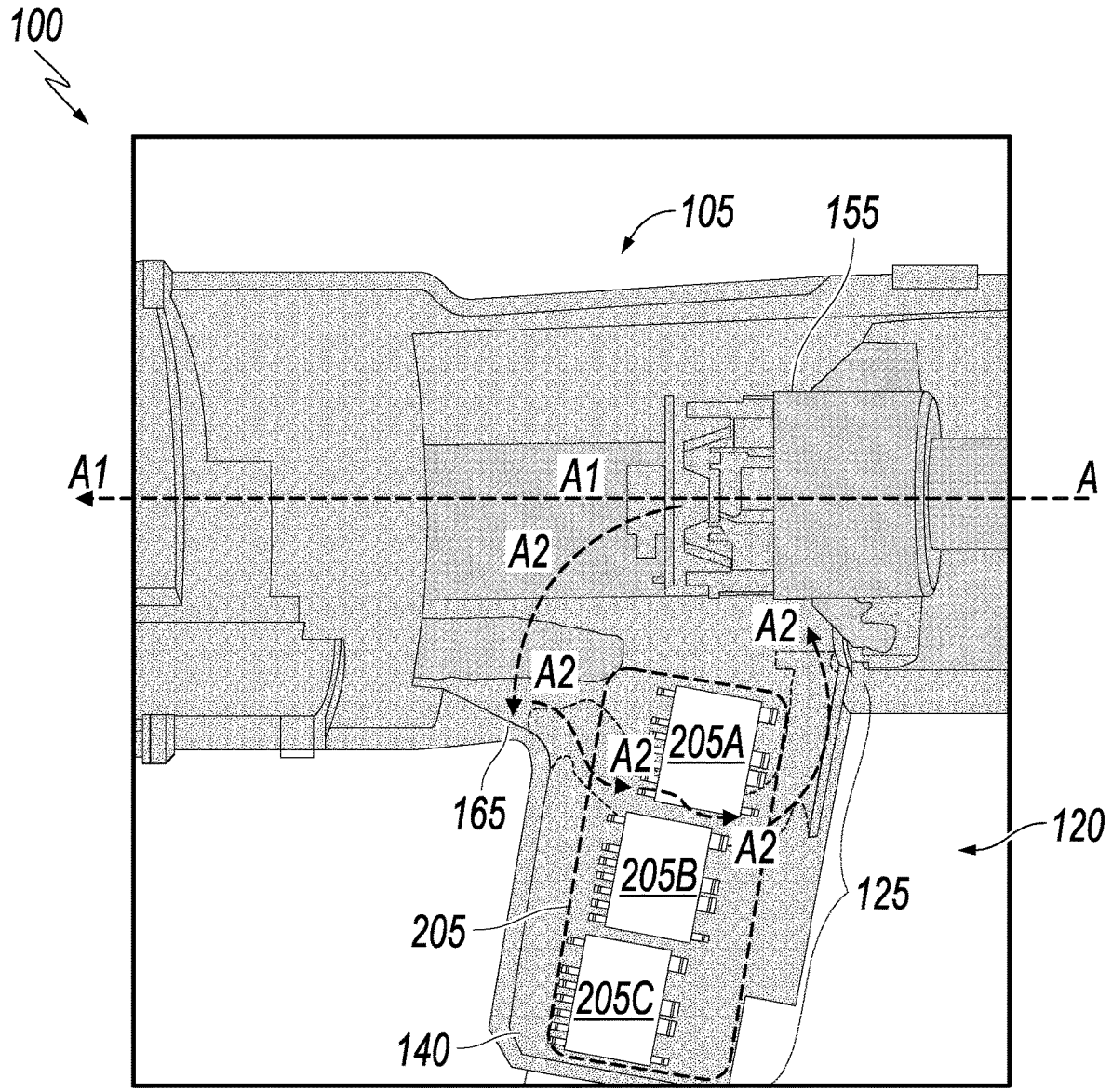
FIG. 4 is an image showing thermal data associated with the airflow of the hair care appliance of FIG. 1.
Figure 5:
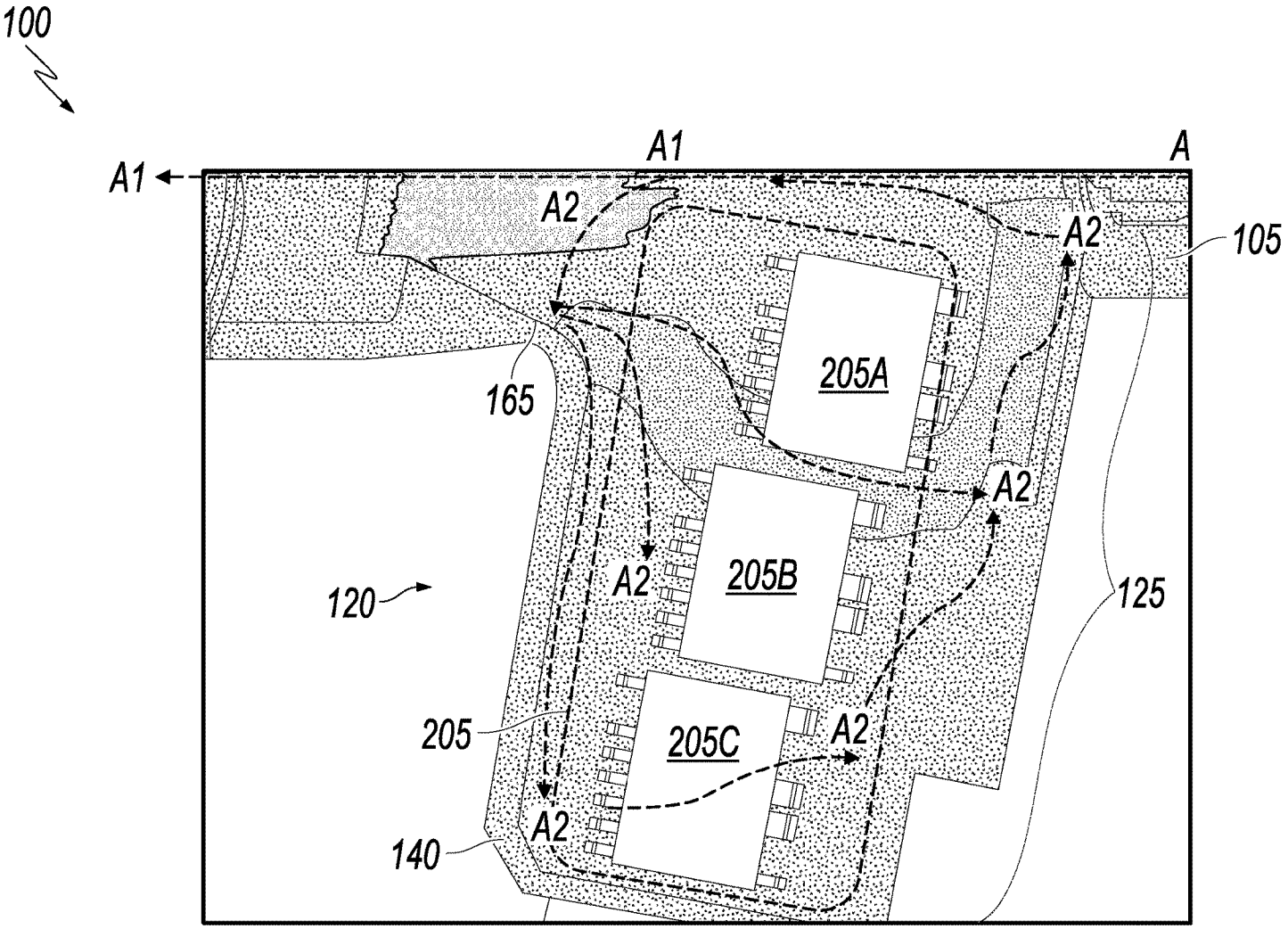
FIG. 5 is an image showing airflow velocity data associated with the airflow of the hair care appliance of FIG. 1.

Cooling of the first set of electrical components 205 in the first section 125 of the handle 120 is illustrated by the thermal data shown in FIG. 4. As shown, a portion A2 of the airflow A is diverted by the diverter 165 into the first section 125 of the handle 120 to flow over and around the first set of electrical components 205. As shown in FIG. 4, the upper-most electrical component 205A receives the greatest airflow A2 due to its proximity to the diverter 165. As shown in FIG. 5, airflow velocity is greatest around and over the upper-most electrical component 205A. The diverter 165 is effective to create sufficient airflow velocity of the airflow A2 so as to surround and flow over the remaining electrical components 205B, 205C before flowing back toward the body 105 to rejoin the main airflow A1 through the body 105. Thus, the diverter 165 can effectively provide cooling to all electrical components located in the first section 125 of the handle 120.

Figure 6:
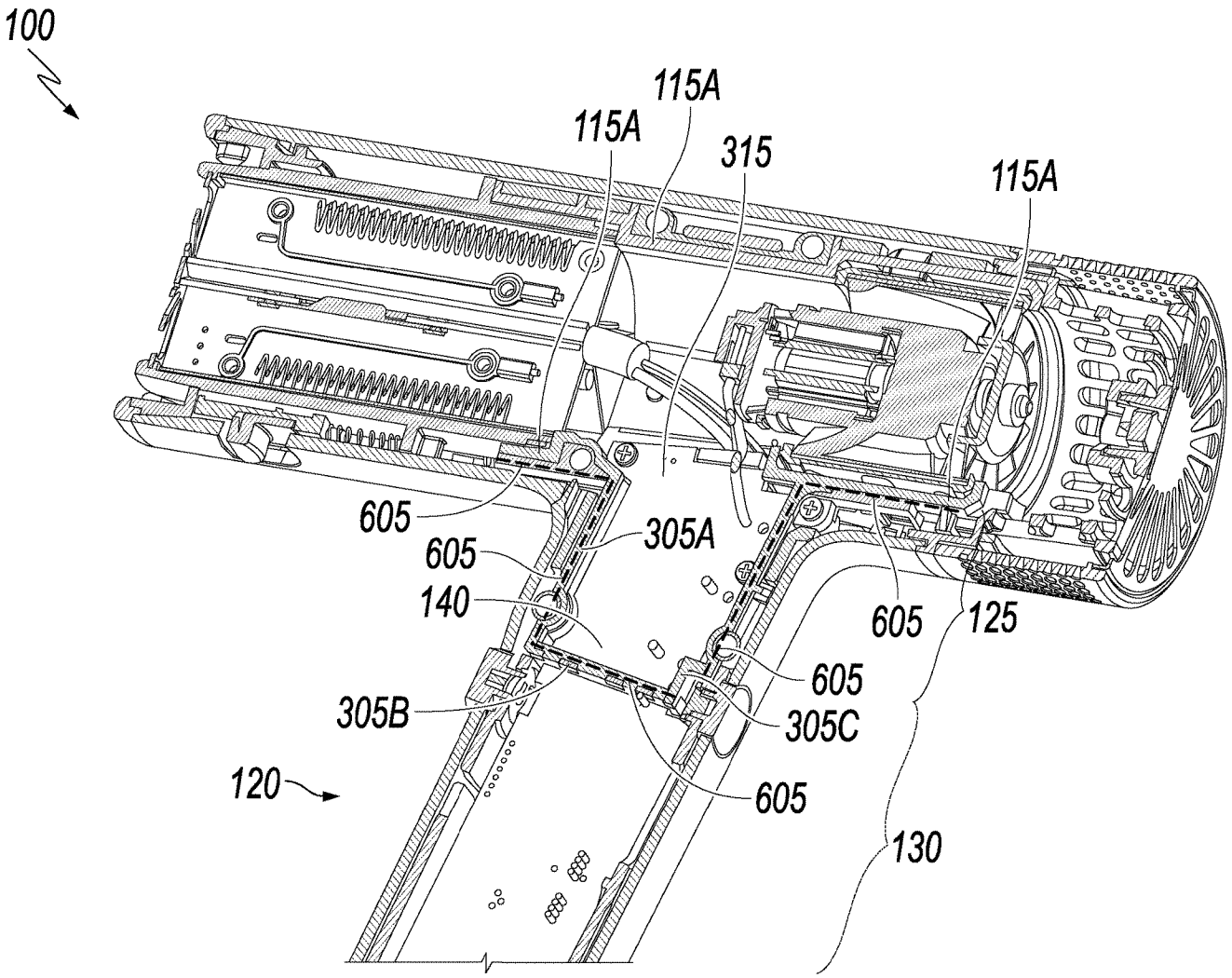
FIG. 6 is a cross-sectional view of the hair care appliance of FIG. 1 showing a sealing element provided in the handle.
Figure 7:
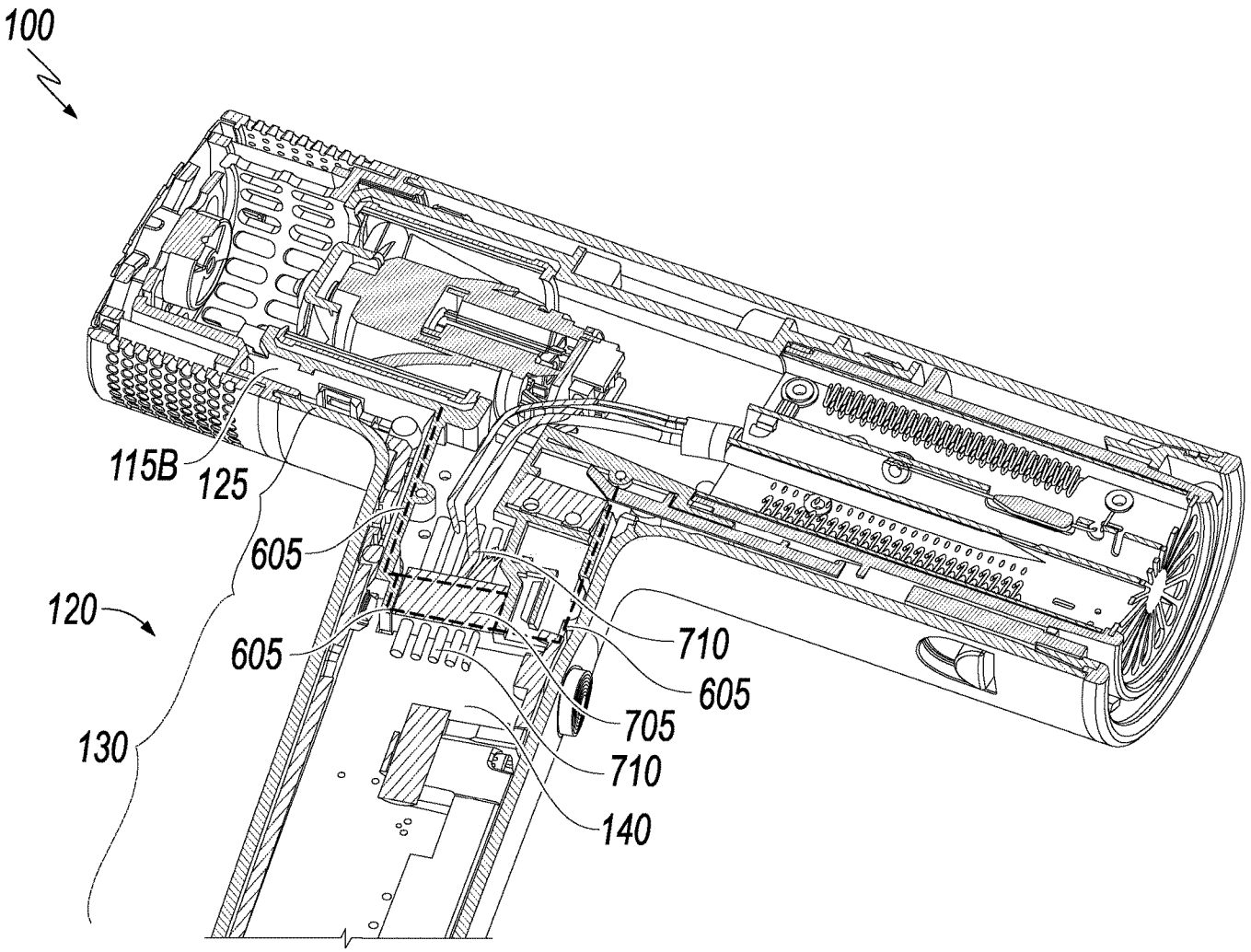
FIG. 7 is a another cross-sectional view of the hair care appliance of FIG. 1 showing a sealing grommet provided in the handle.

A sealing element 605 (shown in dashed lines) can be provided between the internal frame structures 115A, 115B to fluidically seal the first section 125 of the handle 120 from the second section 130 of the handle 120 as shown in FIG. 6. The PCB 140 can be positioned between the internal frame structures 115A and 115B. The sealing element 605 can be provided between the walls 305A-305C when the internal frame structures 115A and 115B are mated together. The interal frame structures 115A and 115B (as well as the walls 305A-305C) can include a track to receive the sealing element 605 therein. The upper and lower portions of the internal frame 115 can include an opening 315 therebetween that fluidically connects the lower portion to the airflow A2 exiting the fan assembly 155. As a result, airflow A2 exiting the fan assembly 155 can enter the handle 120 via the opening 315. As further shown in FIG. 7, a sealing grommet 705 can be positioned in the first section 125 of the handle 120 and adjacent to the PCB 140 to allow wires 710 the pass therethrough while maintaining a fluidic seal between the first section 125 and the second section 130 of the handle 130.

The diverter and sealed compartment of the improved hair care appliance described herein produce a number of advantages. For example, the diverter can direct a portion of airflow into the sealed compartment to cool electrical components located therein. Cooling the electrical components can advantageously ensure safe operation of the device, eliminate overheating of the electrical components, and prolong the lifespan of the electrical components and the hair care appliance. Additionally, because the compartment containing the electrical components in the first section of the handle is sealed from other sections of the handle, the overall airflow produced at the outlet can be maintained with minimal reduction in velocity as a result of directing the airflow into a smaller volume of the sealed compartment.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. A hair care appliance, comprising:

a handle; and a body coupled to the handle and including a fan assembly configured to generate an airflow and at least one sidewall extending into the handle and comprising a first angled portion and a second portion extending from the first angled portion in parallel with the handle, wherein a first portion of the airflow flows from an inlet of the body to an outlet of the body and the first angled portion of the at least one sidewall is configured to direct a second portion of the airflow flows into the handle to cool at least one electrical component provided in the handle.

2. The hair care appliance of claim 1, wherein the first angled portion of the at least one sidewall of the body defines a diverter configured to direct the second portion of the airflow into the handle.

3. The hair care appliance of claim 2, wherein the diverter is positioned to generate the second portion of the airflow from the first portion of the airflow exiting the fan assembly.

4. The hair care appliance of claim 1, wherein the handle includes a first portion having the at least one electrical component and a second portion that is fluidically sealed from the first portion of the handle.

5. The hair care appliance of claim 4, wherein the second portion of the airflow is excluded from the second portion of the handle.

6. The hair care appliance of claim 4, wherein the airflow flows into the first portion of the handle and circulates around the at least one electrical component prior to flowing into the body to join with the first portion of the airflow exiting the fan assembly.

7. The hair care appliance of claim 2, wherein the diverter is configured at an angle relative to the first portion of the airflow.

8. The hair care appliance of claim 2, wherein the diverter is configured parallel to the second portion of the airflow.

9. A hair care appliance, comprising:

a body including an inlet, an outlet, and a fan assembly positioned between the inlet and the outlet, the fan assembly configured to generate an airflow from the inlet to the outlet;

a handle including a first section having an open first end coupled to the body and a second end coupled to a second section of the handle fluidically sealed from the first section, the first section including at least one electrical component therein, and wherein a portion of the airflow flows is diverted into the first section of the handle by an angled portion of at least one sidewall extending between the body and the handle, the angled portion extending into the open first end of the handle, wherein the portion of the airflow configured to cool the at least one electrical component.

10. The hair care appliance of claim 9, wherein the second section of the handle includes at least one electrical component therein, and wherein each at least one electrical component in the second section has a maximum heat output that is less than a maximum heat output of each at least one electrical component in the first section.

11. The hair care appliance of claim 9, wherein the handle includes a sealing element configured to fluidically seal the first section of the handle from the second section of the handle.

12. The hair care appliance of claim 9, wherein the first end of the handle includes an opening configured to receive the portion of the air flow.

13. The hair care appliance of claim 12, wherein the opening is configured to be in fluidic connection with the airflow exiting the fan assembly.

14. A hair care appliance, comprising:

a frame having a first portion extending along a first axis, a second portion extending along a second axis transverse to the first axis, and at least one sidewall extending between the first portion and the second portion of the frame, the first portion of the frame having a fan assembly and a heater assembly disposed therein, and the second portion of the frame having at least one electrical component therein;

a body positioned at least partially around the first portion of the frame and including an inlet and an outlet, the fan assembly being configured to generate an airflow from the inlet, through the fan assembly, to the outlet, wherein a first angled portion of the at least one sidewall is configured to divert a first portion of the airflow into the second portion of the frame to cool the at least one electrical component; and a handle positioned at least partially around the second portion of the frame, wherein a second portion of the at least one sidewall extends from the first angled portion into the second portion of the frame parallel with the second axis.

15. The hair care appliance of claim 14, wherein the frame includes a first inner frame structure coupled to a second inner frame structure, such that the first portion of the frame and a second portion of the airflow are parallel to the first axis.

16. The hair care appliance of claim 15, wherein the first inner frame structure includes a first plurality of walls and the second inner frame structure includes a second plurality of walls, the first and second plurality of walls extending into the handle and forming a compartment in a first section of the handle, the compartment containing the at least one electrical component.

17. The hair care appliance of claim 16, wherein the first plurality of walls are coupled to the second plurality of walls via a sealing element, such that the compartment in the first section of the handle is fluidically sealed from a second section of the handle.

18. The hair care appliance of claim 16, wherein at least one wall of the first plurality of walls and at least one wall of the second plurality of walls form the at least one sidewall and divert the first portion of the airflow into the second portion of the frame, the first portion of the airflow transverse to the second portion of the airflow.

19. The hair care appliance of claim 17, wherein the first section of the handle includes a first plurality of electrical components and the second section of the handle includes a second plurality of electrical components, the first plurality of electrical components having a maximum heat output that is higher than a maximum heat output of the second plurality of electrical components.

20. The hair care appliance of claim 14, wherein the at least one electrical component includes a metal-oxide semiconductor field-effect transistor configured on a printed circuit board positioned within the handle.

* * * * *